US011069988B1

(12) United States Patent
Huang et al.

(10) Patent No.: US 11,069,988 B1
(45) Date of Patent: Jul. 20, 2021

(54) DIVERSE INTEGRATION MODULE SYSTEM OF MILLIMETER-WAVE AND NON-MILLIMETER-WAVE ANTENNAS AND ELECTRONIC APPARATUS

(71) Applicants: ETHETA COMMUNICATION TECHNOLOGY (SHENZHEN) CO., LTD., Shenzhen (CN); EAST CHINA RESEARCH INSTITUTE OF MICROELECTRONICS, Hefei (CN)

(72) Inventors: Huan-Chu Huang, Taoyuan (TW); Jiaguo Lu, Hefei (CN); Hong Lin, Shenzhen (CN); Junyong Liu, Hefei (CN); Zhixing Qi, Shenzhen (CN); Minhui Zeng, Hefei (CN); Yanchao Zhou, Shenzhen (CN); Jingwei Li, Hefei (CN); Tao Ma, Hefei (CN)

( * ) Notice: Subject to any disclaimer, the term of this patent is extended or adjusted under 35 U.S.C. 154(b) by 0 days.

(21) Appl. No.: 16/921,013

(22) Filed: Jul. 6, 2020

(30) Foreign Application Priority Data

Apr. 30, 2020 (CN) ..... 202010370383.7

(51) Int. Cl.

| | |
|---|---|
| ***H01Q 1/24*** | (2006.01) |
| ***H01Q 21/28*** | (2006.01) |
| ***H01Q 9/04*** | (2006.01) |
| ***H01Q 21/06*** | (2006.01) |

(52) U.S. Cl.
CPC ..... *H01Q 21/28* (2013.01); *H01Q 9/045* (2013.01); *H01Q 21/065* (2013.01)

(58) Field of Classification Search
CPC ..... H01Q 21/28; H01Q 21/065; H01Q 9/045
See application file for complete search history.

(56) References Cited

U.S. PATENT DOCUMENTS

| | | | | |
|---|---|---|---|---|
| 2014/0145883 | A1* | 5/2014 | Baks | H01Q 1/2283 343/700 MS |
| 2017/0062953 | A1* | 3/2017 | Teshima | H01Q 3/24 |
| 2017/0201014 | A1* | 7/2017 | Lee | H01Q 15/02 |
| 2018/0248250 | A1* | 8/2018 | Hsu | H04M 1/0283 |

(Continued)

FOREIGN PATENT DOCUMENTS

CN 110534924 A * 12/2019

*Primary Examiner* — Dieu Hien T Duong
(74) *Attorney, Agent, or Firm* — HYIP

(57) ABSTRACT

The present invention relates to a diverse integration module system of millimeter-wave and non-millimeter-wave antennas and an electronic apparatus, the diverse integration module system of antennas comprising an integration module of millimeter-wave and non-millimeter-wave antennas and a non-millimeter-wave environment, the integration module of millimeter-wave and non-millimeter-wave antennas comprising a millimeter-wave antenna module provided with one or more first non-millimeter-wave antennas, the millimeter-wave antenna module being further provided thereon with a first communication part that is communicatively connected to the non-millimeter-wave environment, both the first non-millimeter-wave antenna(s) and the first communication part forming a communication connection with the non-millimeter-wave environment and a method for designing non-millimeter-wave antenna(s) on a millimeter-wave antenna module and simultaneously further directly reusing the millimeter-wave antenna module.

13 Claims, 9 Drawing Sheets

(56) References Cited

U.S. PATENT DOCUMENTS

| | | | | |
|---|---|---|---|---|
| 2019/0027838 | A1* | 1/2019 | Paulotto | H01Q 21/28 |
| 2020/0036083 | A1* | 1/2020 | Kim | H01Q 5/25 |
| 2020/0203836 | A1* | 6/2020 | Park | H01Q 21/08 |

* cited by examiner

DIVERSE INTEGRATION MODULE SYSTEM OF MILLIMETER-WAVE AND NON-MILLIMETER-WAVE ANTENNAS AND ELECTRONIC APPARATUS

CROSS-REFERENCE TO RELATED APPLICATION

This application claims priority to and the benefit of Chinese Patent Application No. 2020103703837 filed Apr. 30, 2020, the contents of which is incorporated herein by reference in its entirety.

FIELD OF THE INVENTION

The present invention relates to the field of antenna technology, and in particular to a diverse integration module system of millimeter-wave and non-millimeter-wave antennas and an electronic apparatus.

BACKGROUND OF THE INVENTION

With the arrival of the 5G age, due to the requirements for higher-order multiple-input and multiple-output (MIMO) communications, the requirements for coverage of more new frequency bands, and even the addition of millimeter-wave bands, a greater number of antennas (comprising millimeter-wave and non-millimeter-wave antennas) are required. Nevertheless, it results in higher difficulty in antenna design in the case where the space of a whole device cannot be significantly increased. Furthermore, the size of the whole device will be even increased due to the insufficiently compact antenna arrangement or design, resulting in a decline in product competitiveness. The 5G frequency bands are divided into millimeter-wave bands and non-millimeter-wave bands. At present, the mainstream antenna design scheme for non-millimeter-wave bands is to have separate antennas, and the mainstream implementation types comprise stamped iron sheet, flexible printed circuit (FPC), laser direct structuring (LDS), printed direct structuring (PDS), etc.; and the current mainstream antenna design scheme for millimeter-wave bands is the integrated antenna-in-package (AiP), that is, an antenna (or antennas) and a chip, especially a radio frequency chip, i.e., a radio frequency integrated circuit (RFIC), are integrated into a packaged antenna module. As mentioned above, the number of antennas has been increased significantly in the 5G age, and thus a 5G device requires multiple separate 5G non-millimeter-wave antennas and several 5G millimeter-wave antenna modules (if the device can support millimeter-wave band communications).

Therefore, in view of this, a Chinese patent CN201910760335.6 proposes a scheme of an integration module of millimeter-wave and non-millimeter-wave antennas; however, the independent claims of the patent are based on the following: 1) millimeter-wave antennas are dipole antennas; and 2) a substrate comprises a floor, a first dielectric layer and a second dielectric layer, and the first dielectric layer and the second dielectric layer are respectively located on two sides of the floor; a radio frequency integrated circuit is provided on the first dielectric layer, and the radio frequency integrated circuit is connected to a feeding structure of N dipole antenna units; and a non-millimeter-wave antenna is provided on the second dielectric layer. Therefore, what is protected by this patent is that the radio frequency integrated circuit and the non-millimeter-wave antenna are parallel and provided on different layers.

In view of the above, it results in higher difficulty in antenna design or higher cost in the case where the space of a whole device cannot be significantly increased but there are requirements for communications which result in the need to accommodate more 5G (millimeter-wave and non-millimeter-wave) antennas. Furthermore, the size of the whole device will be even increased due to the insufficiently compact antenna arrangement or design, resulting in a decline in product competitiveness. The Chinese patent CN201910760335.6 proposes adding non-millimeter-wave antenna traces to a module so that millimeter-wave and non-millimeter-wave antennas are integrated on one module, but this design will occupy a larger area in a horizontal plane.

SUMMARY OF THE INVENTION

The present invention is exactly aimed at the above existing problems, and the present invention provides a diverse integration module system of millimeter-wave and non-millimeter-wave antennas and an electronic apparatus.

To achieve the above object, the specific technical solution of the present invention is as follows:

A diverse integration module system of millimeter-wave and non-millimeter-wave antennas comprises an integration module of millimeter-wave and non-millimeter-wave antennas and a non-millimeter-wave environment, the integration module of millimeter-wave and non-millimeter-wave antennas comprising a millimeter-wave antenna module provided with one or more first non-millimeter-wave antennas, the millimeter-wave antenna module being further provided thereon with a first communication part that is communicatively connected to the non-millimeter-wave environment, both the first non-millimeter-wave antenna(s) and the first communication part forming a communication connection with the non-millimeter-wave environment for realizing hybrid reusing of the millimeter-wave antenna module to achieve a function of diverse non-millimeter-wave antenna(s).

As a preferred technical solution of the present invention, the millimeter-wave antenna module further comprises a module carrier, one or more millimeter-wave antennas, and a millimeter-wave radio frequency chip, and the millimeter-wave radio frequency chip is electrically connected to the millimeter-wave antenna(s).

As a preferred technical solution of the present invention, the millimeter-wave radio frequency chip and the non-millimeter-wave antenna(s) are set in the same plane at the module carrier or in non-parallel space at the module carrier. Such an arrangement, especially the arrangement in non-parallel space, can make full use of the height space on sides of a mobile phone, and will not occupy a larger area in a horizontal plane, achieving a more compact antenna design without resulting in an increase in size and cost of the whole device, and improving the product competitiveness.

As a preferred technical solution of the present invention, the non-millimeter-wave environment comprises feeding line(s) for one or more non-millimeter-wave antennas and feeding source(s) for non-millimeter-wave antenna(s), and the feeding source(s) for non-millimeter-wave antenna(s) forms a communication connection with the millimeter-wave antenna module via the feeding line(s) for the non-millimeter-wave antenna(s) for realizing reusing of the millimeter-wave antenna module to achieve the function of non-millimeter-wave antenna(s).

As a preferred technical solution of the present invention, the communication connection is an electrical connection, or a coupling connection, or an inductive connection.

As a preferred technical solution of the present invention, the first communication part is configured as a conductive region on the module carrier, which conductive region makes an electrical connection, or a coupling connection, or an inductive connection with the feeding line(s) for the non-millimeter-wave antenna(s); and this conductive region is electrically conductive to a conductive ground or a conductive mechanism in the millimeter-wave antenna module.

As a preferred technical solution of the present invention, the feeding line(s) for the non-millimeter-wave antenna(s) is further provided thereon with a matching network and/or a frequency tuning network for non-millimeter-wave antenna(s).

As a preferred technical solution of the present invention, the system is further provided with a thermally conductive or electrically conductive material for conducting heat from a high-heat region of the system to the outside.

As a preferred technical solution of the present invention, the system further comprises other chips which, together with the millimeter-wave radio frequency chip, is the high-heat region, and the other chips are selected from any one or more of a power management chip, an operation processing chip, and a data storage chip.

The millimeter-wave antenna module of the present invention comprises millimeter-wave antenna(s) or an array constituted by the millimeter-wave antenna(s) (which may be a linear array, a square array, a rectangular array, a triangular array, a circular array, or a non-equidistant arbitrarily shaped array, etc.), and more than one antenna array may also be constituted, and thus the number of the millimeter-wave antenna(s) may be one or more, and the millimeter-wave antenna(s) may be in various forms of a single linearly-polarized antenna, a dual linearly-polarized antenna, a single circularly-polarized antenna, or a dual circularly-polarized antenna, etc. working in a single band or multiple bands, e.g., a monopole antenna, a dipole antenna, a patch antenna, a stacked patch antenna, an inverted F antenna (IFA), a planar inverted F antenna (PIFA), a Yagi-Uda antenna, a slot antenna, a magnetic-electric dipole antenna, a horn antenna, a loop antenna, a grid antenna, a cavity-backed antenna, etc. More than two (including two) millimeter-wave antennas may be different from each other as to antenna form, and more than three (including three) millimeter-wave antennas may be unequal as to spacing thereof, and the millimeter-wave antennas may be distributed on various surfaces of the module (that is, the millimeter-wave antennas are not limited to being distributed on a single surface of the module).

The number of the non-millimeter-wave antenna(s) whose function is achieved by reusing the millimeter-wave antenna module may be one or more. The non-millimeter-wave antenna(s) may also be in the form of a monopole antenna, a dipole antenna, a patch antenna, a stacked patch antenna, an inverted F antenna (IFA), a planar inverted F antenna (PIFA), a Yagi-Uda antenna, a slot antenna, a magnetic-electric dipole antenna, a horn antenna, a loop antenna, a grid antenna, and a cavity-backed antenna, the reused module can achieve more than one non-millimeter-wave antenna, and these multiple non-millimeter-wave antennas do not necessarily need to be in the same form. The shape of this millimeter-wave antenna module may be any shape such as square, rectangle, triangle, trapezoid, L-shape, T-shape, V-shape, U-shape, "concave" shape, "convex" shape, "mouth" shape, circle, ellipse, arc, etc. The material of the antenna module of the present invention comprises, but is not limited to, ceramic (e.g., ceramic types like low-temperature co-fired ceramic (LTCC), or high-temperature co-fired ceramic (HTCC), etc.), a printed circuit board (PCB), a flexible circuit board (FPC) (comprising liquid crystal polymer (LCP) or modified PI (MPI), etc.).

The present invention further provides an electronic apparatus employing the above diverse integration module system of antennas, the millimeter-wave antenna module being provided thereon with a connecting base, the connecting base being connected to a mainboard of the electronic apparatus, wherein the non-millimeter-wave environment is provided on the mainboard of the electronic apparatus.

The present invention proposes designing non-millimeter-wave antenna(s) on a millimeter-wave antenna module and simultaneously further directly reusing the millimeter-wave antenna module, which is designed so that this module also has an equivalent function of non-millimeter-wave antenna(s), that is, the present invention directly reuses the millimeter-wave antenna module and equivalently reuses the millimeter-wave antenna module simultaneously in a hybrid manner, so as to achieve a function of more complete and diverse non-millimeter-wave antenna(s); also, the system design of a whole device can be more compact and have a more ultimate size, making it possible to improve the comprehensive competitiveness of the whole product.

DETAILED DESCRIPTION OF THE INVENTION

In order to enable those ordinarily skilled in the art to be able to understand and implement the present invention, examples of the present invention will be further described below in conjunction with the accompanying drawings.

With reference made to FIGS. 1 to 9, the present invention provides a diverse integration module system of millimeter-wave and non-millimeter-wave antennas, which comprises an integration module 1 of millimeter-wave and non-millimeter-wave antennas and a non-millimeter-wave environment 2, the integration module 1 of millimeter-wave and non-millimeter-wave antennas comprises a millimeter-wave antenna module 11 provided with one or more first non-millimeter-wave antennas 113, the millimeter-wave antenna module 11 is further provided thereon with a first communication part that is communicatively connected to the non-millimeter-wave environment 2, and both the first non-millimeter-wave antenna(s) 113 and the first communication part form a communication connection with the non-millimeter-wave environment 2 for realizing hybrid reusing of the millimeter-wave antenna module 11 to achieve a function of diverse non-millimeter-wave antenna(s).

Example One

Figure 1A:
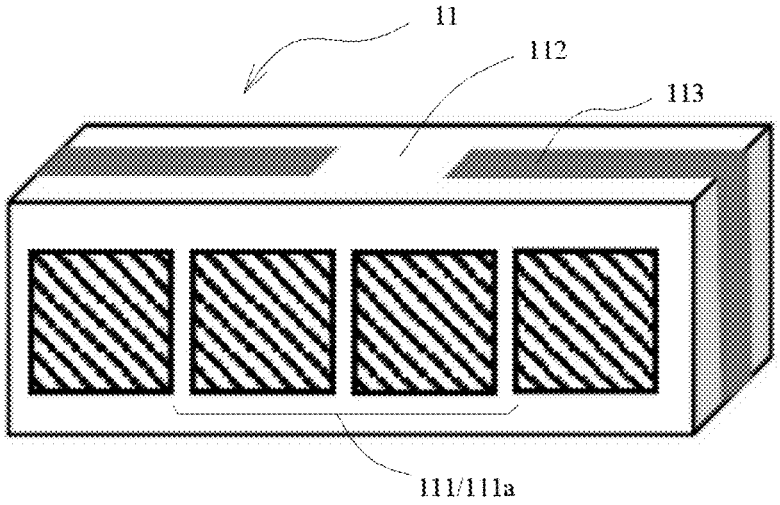
FIG. 1A is a front view and FIG. 1B is a rear view of a millimeter-wave antenna module of Example One of the present invention.
Figure 1B:
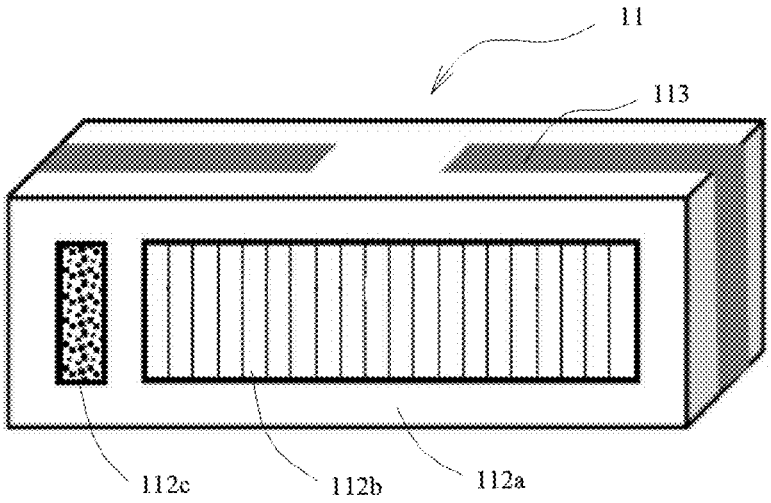
Figure 2A:
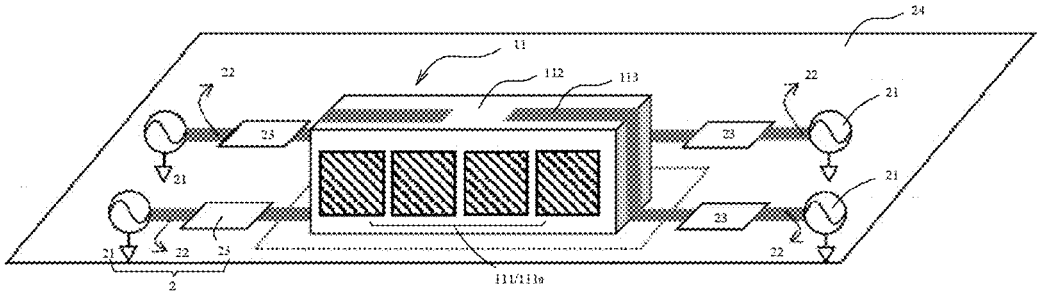
FIG. 2A is a front view and FIG. 2B is a rear view of a diverse integration module system of millimeter-wave and non-millimeter-wave antennas of Example One of the present invention.
Figure 2B:
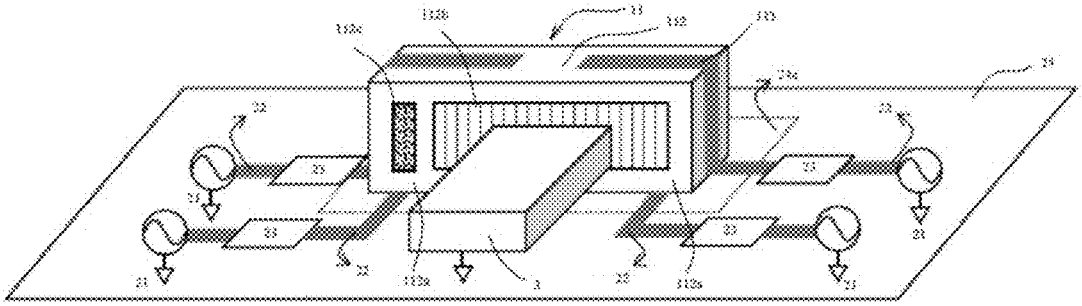

As shown in Example One of FIG. 1A and FIG. 1B, a millimeter-wave antenna module 11 in this example has (but is not limited to) a one-dimensional linear array formed by four millimeter-wave antennas 111, and the millimeter-wave antenna array 111*a* is mainly provided on a front long-side vertical face (i.e., on a front face) of the module. On a rear long-side vertical face (i.e., on a back face) of the module, a chip (comprising chip(s) like a millimeter-wave radio frequency chip, i.e., a RFIC, or the former plus a power management IC, i.e., a PMIC, etc.), and/or associated electronic components, and/or a chip shielding facility (e.g., a shielding cover or a shielding layer 112*b*), and/or a connecting base 112*c* (connector or socket), etc. may be placed. A radio frequency path of the radio frequency chip is electrically connected to feeding ports of the millimeter-wave antennas.

The millimeter-wave antennas may be in various antenna forms described above, and a size of each millimeter-wave antenna is preferably not greater than 2 equivalent guided wavelengths at its lowest operating frequency, and a spacing of the millimeter-wave antennas is preferably not greater than 2 free-space wavelengths at its lowest operating frequency. First non-millimeter-wave antenna(s) 113 carried on the millimeter-wave antenna module 11 in this example is electrically connected by feeding source(s) 21 for non-millimeter-wave antenna(s) via feeding line(s) 22 for the non-millimeter-wave antenna(s) (with matching network(s) 23, and/or frequency tuning network(s)). Besides, the back face (or a part thereof) of the millimeter-wave antenna module 11 is a conductive wall or conductive region 112*a*, non-millimeter-wave feeding source(s) 21 can be fed into the back face of the millimeter-wave antenna module 11 through an electrical connection via antenna feeding line(s) 22 (with matching network(s) 23, and/or frequency tuning network(s)), and this conductive wall or conductive region 112*a* is electrically conductive to a conductive ground or a conductive structure (preferably a metal ground or a metal structure) in a module carrier 112. In this way, the millimeter-wave antenna module 11 can have the function of a plurality of (four) non-millimeter antennas, achieving a more complete and diverse antenna design with a more compact space, i.e., achieving an integration module scheme that can cover millimeter-wave bands and (multiple) non-millimeter-wave bands of 5G. In addition, in order to strengthen heat dissipation, an electrically conductive or thermally conductive material 3 may be added to be connected to the shielding cover or shielding layer 112*b* of a chip region to conduct and remove heat from the chip region to the outside. The system setting diagrams of this diverse integration module are shown as FIG. 2A and FIG. 2B.

In the example of the present invention, the non-millimeter-wave environment 2 comprising the non-millimeter-wave feeding source 21, the feeding line(s) 22 for the non-millimeter-wave antenna(s), and matching network(s) 23 (and/or frequency tuning network(s)) for non-millimeter-wave antenna(s) is preferably configured on a mainboard 24 of PCB, and through a combination of the mainboard 24 of PCB, the millimeter-wave antenna module 11 and the non-millimeter-wave environment 2, an electronic apparatus that reuses the millimeter-wave antenna module 11 to achieve the function of non-millimeter-wave antenna(s) can be provided. At this time, a coverage region of the module carrier 112 of the millimeter-wave antenna module 11 and its extension region on the mainboard 24 of PCB are set as a clearance region 24*a* of the millimeter-wave antenna module 11 without copper plating, and the module carrier 112 is provided thereon with a connecting base 112*c*, which is electrically connected to the mainboard 24 of PCB, of the electronic apparatus.

Example Two

Figure 3:
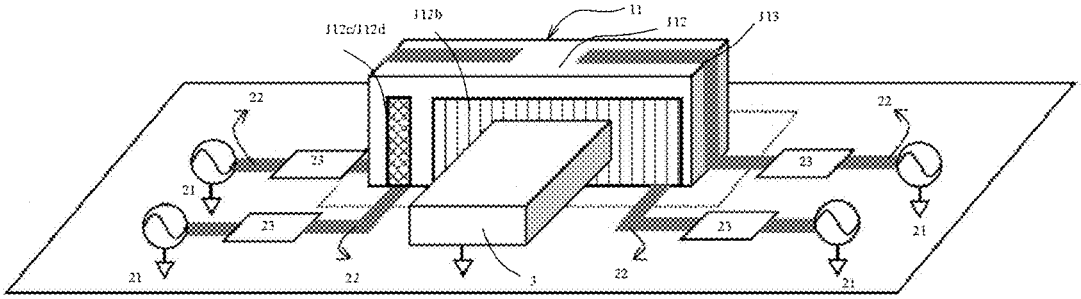
FIG. 3 is a rear view of a diverse integration module system of millimeter-wave and non-millimeter-wave antennas of Example Two of the present invention.

As shown in Example Two of FIG. 3, the example differs from Example One in the following: first non-millimeter-wave antenna(s) 113 carried on a millimeter-wave antenna module 11 in this example is electrically connected by a feeding source 21 for non-millimeter-wave antenna(s) via feeding line(s) 22 for the non-millimeter-wave antenna(s) (with matching network(s) 23, and/or frequency tuning network(s)). And, a non-millimeter-wave feeding source 21 in this example can be fed into a shielding cover or shielding layer 112*b* of the millimeter-wave antenna module 11 and a connector 112*d* (which is a conductive part) in a snap-fit relationship with a connecting base 112*c* through an electrical connection via feeding line(s) 22 for the non-millimeter-wave antenna(s) (with matching network(s) 23, and/or a frequency tuning network(s)), and this shielding cover or shielding layer 112*b* and the connector 112*d* (which is a conductive part) on the connecting base 112*c* are electrically conductive to a conductive ground or a conductive structure (preferably a metal ground or a metal structure) in a module carrier 12. In this way, the millimeter-wave antenna module 11 can have the function of a plurality of (four) non-millimeter antennas, achieving a more complete and diverse antenna design, i.e., achieving an integration module scheme that can cover millimeter-wave bands and (multiple) non-millimeter-wave bands of 5G. In addition, in order to strengthen heat dissipation, an electrically conductive or thermally conductive material 3 may be added to be connected to the shielding cover or shielding layer 112*b* of a chip region to conduct and remove heat from the chip region to the outside.

Example Three

Figure 4:
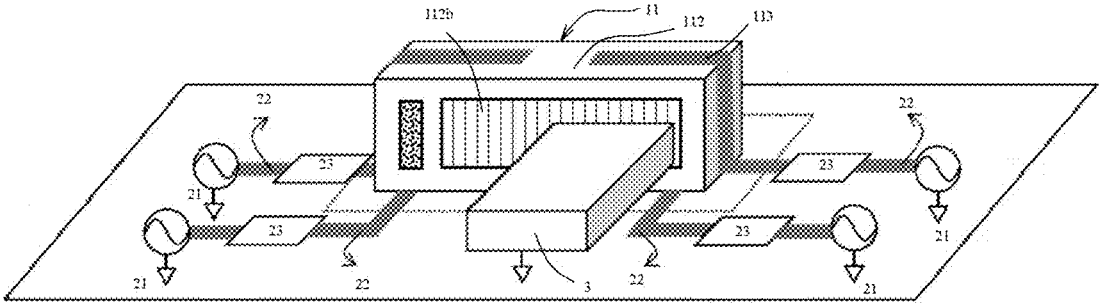
FIG. 4 is a rear view of a diverse integration module system of millimeter-wave and non-millimeter-wave antennas of Example Three of the present invention.

As shown in Example Three of FIG. 4, the differences between this example and Example One are as follows: an electrically conductive or thermally conductive material 3 for heat dissipation is connected to a chip region's shielding cover or shielding layer 112*b* to conduct and remove heat from the chip region to the outside, and this electrically conductive or thermally conductive material 3 can be also eccentrically placed deliberately to reach multiple antennas with different frequency coverage.

Example Four

Figure 5:
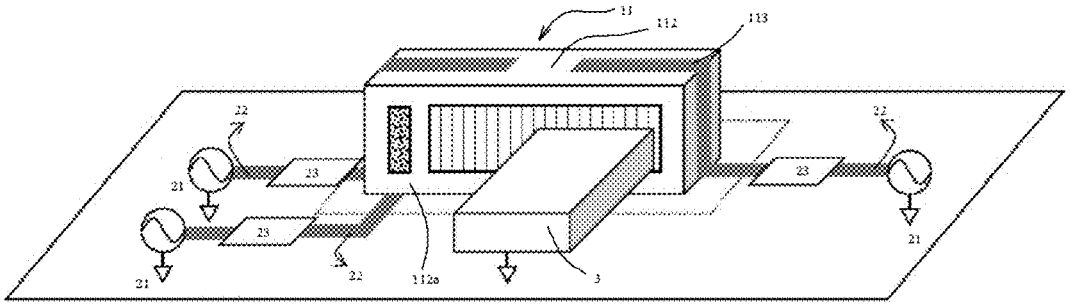
FIG. 5 is a rear view of a diverse integration module system of millimeter-wave and non-millimeter-wave antennas of Example Four of the present invention.

As shown in Example Four of FIG. 5, this example differs from Example Three in that in the former, an electrical connection of one non-millimeter-wave feeding source 21, a feeding line 22 for non-millimeter-wave antenna(s) (with a matching network 23, and/or a frequency tuning network), on the one hand, with a conductive wall or conductive region 112*a*, on the other hand, is removed.

Example Five

Figure 6:
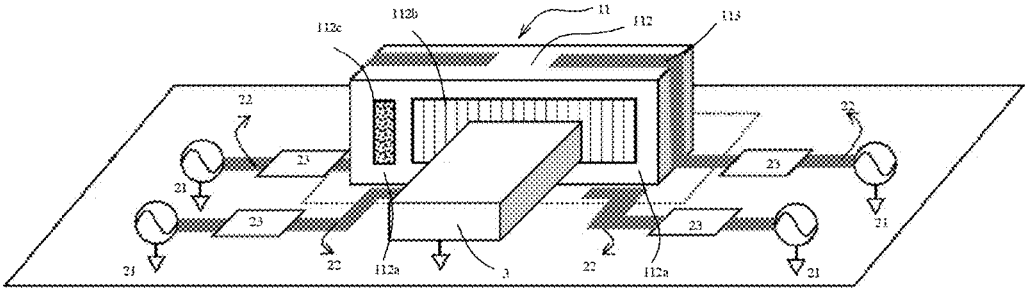
FIG. 6 is a rear view of a diverse integration module system of millimeter-wave and non-millimeter-wave antennas of Example Five of the present invention.

As shown in Example Five of FIG. 6, the differences between this example and Example One are as follows: a back face (or a part thereof) of this millimeter-wave antenna module 11 is a conductive wall or a conductive region 112*a*, a non-millimeter-wave feeding source 21 can be fed into the back face of the millimeter-wave antenna module 11 by means of excitation via coupling, via feeding line(s) 22 for non-millimeter-wave antenna(s) (with matching network(s) 23, and/or frequency tuning network(s)), a spacing between the antenna feeding line(s) and the millimeter-wave antenna module 11 is preferably not greater than one free-space wavelength, and this conductive wall or conductive region 112*a* is electrically conductive to a conductive ground or a conductive structure (preferably a metal ground or a metal structure) in a module carrier 12. In this way, the millimeter-wave antenna module 11 can have the function of a plurality of (four) non-millimeter antennas, achieving a more complete and diverse antenna design with a more compact space, i.e., achieving an integration module scheme that can cover millimeter-wave bands and (multiple) non-millimeter-wave bands of 5G. In addition, in order to strengthen heat dissipation, an electrically conductive or thermally conductive material 3 may be added to be connected to a chip region's shielding cover or shielding layer 112*b* to conduct and remove heat from the chip region to the outside.

Example Six

Figure 7A:
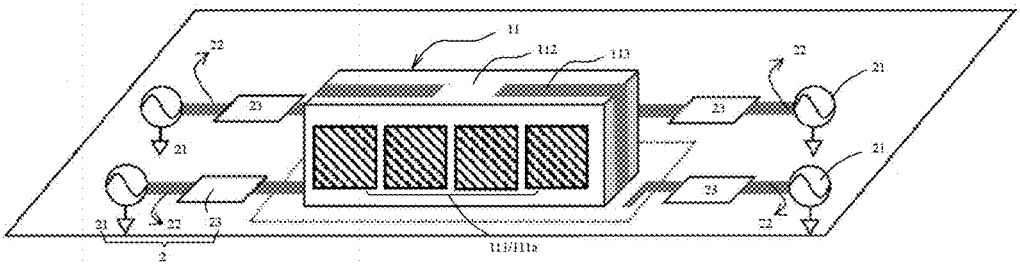
FIG. 7A is a front view and FIG. 7B is a rear view of a diverse integration module system of millimeter-wave and non-millimeter-wave antennas of Example Six of the present invention.
Figure 7B:
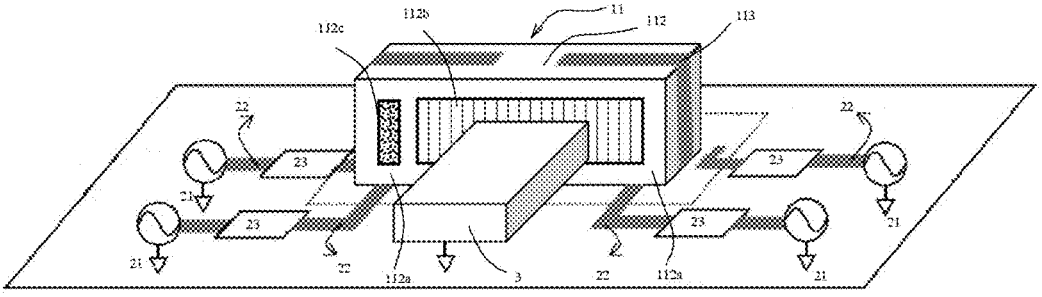

As shown in Example Six of FIG. 7A and FIG. 7B, the differences between this example and Example One are as follows: first non-millimeter-wave antenna(s) 113 carried on a millimeter-wave antenna module 11 in this example is coupled and excited by a feeding source 21 for non-millimeter-wave antenna(s) via feeding line(s) 22 for the non-millimeter-wave antenna(s) (with matching network(s) 23, and/or frequency tuning network(s)), and a spacing between the antenna feeding lines and the antenna module is preferably not greater than one free-space wavelength.

Example Seven

Figure 8A:
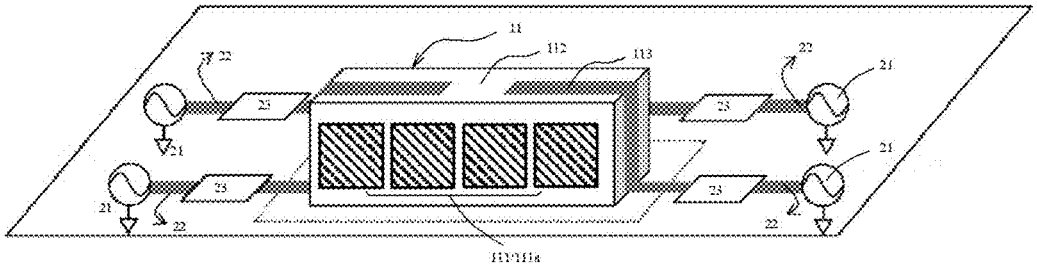
FIG. 8A is a front view and FIG. 8B is a rear view of a diverse integration module system of millimeter-wave and non-millimeter-wave antennas of Example Seven of the present invention.
Figure 8B:
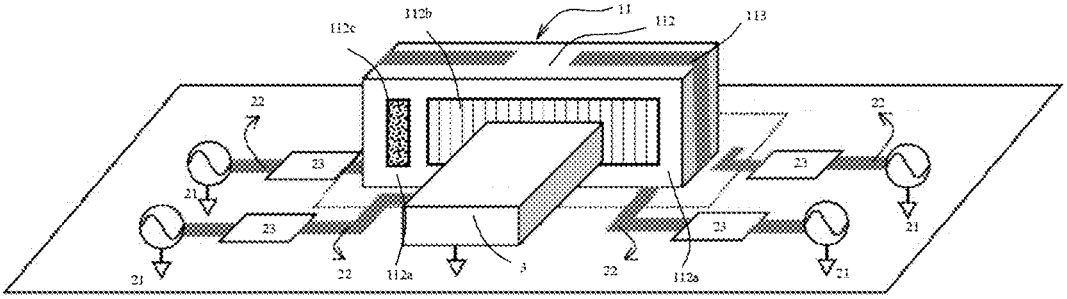

As shown in Example Seven of FIG. 8A and FIG. 8B, the differences between this example and Example Six are as follows: one first non-millimeter-wave antenna 113 carried on a millimeter-wave antenna module 11 in this example is coupled and excited by a feeding source 21 for non-millimeter-wave antenna(s) via a feeding line 22 for the non-millimeter-wave antenna(s) (with a matching network 23, and/or a frequency tuning network), and a spacing between the feeding line 22 for the non-millimeter-wave antenna(s) and the millimeter-wave antenna module 11 is preferably not greater than one free-space wavelength, and another first non-millimeter-wave antenna 113 carried is electrically connected and fed by a feeding source 21 for non-millimeter-wave antenna(s) via a feeding line 22 for the non-millimeter-wave antenna(s) (with a matching network 23, and/or a frequency tuning network).

Example Eight

Figure 9A:
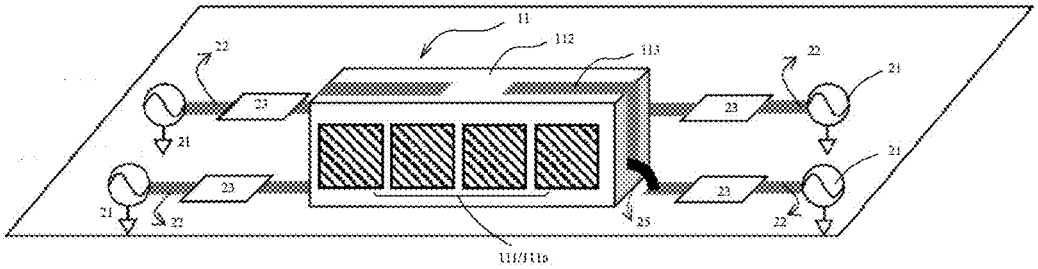
FIG. 9A is a front view and FIG. 9B is a rear view of a diverse integration module system of millimeter-wave and non-millimeter-wave antennas of Example Eight of the present invention.
Figure 9B:
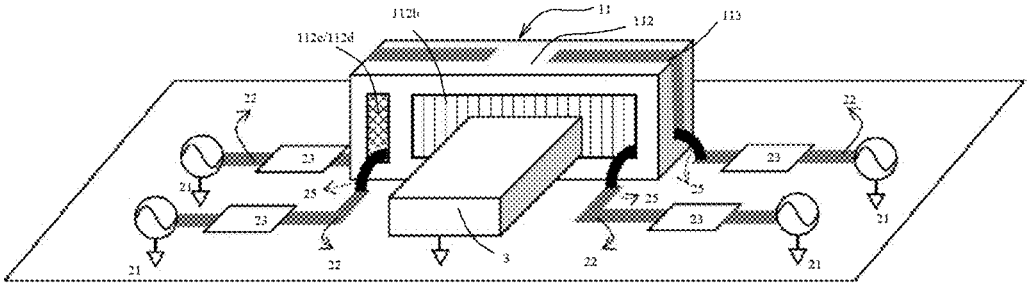

As shown in Example Eight of FIG. 9A and FIG. 9B, the differences between this example and Example One are as follows: first non-millimeter-wave antenna(s) 113 carried on a millimeter-wave antenna module 11 in this example is electrically connected by a feeding source 21 for non-millimeter-wave antenna(s) via feeding line(s) 22 for the non-millimeter-wave antenna(s) (with matching network(s) 23, and/or frequency tuning network(s)) and electrical connection mechanism(s) (e.g., spring(s) 25). Besides, at a back face (or a part thereof) of this millimeter-wave antenna module 11, a non-millimeter-wave feeding source 21 can also be fed into a shielding cover or shielding layer 112*b* of the millimeter-wave antenna module 11 and a connector 112*d* (which is a conductive part) in a snap-fit relationship with a connecting base 112*c* through an electrical connection via feeding line(s) 22 for the non-millimeter-wave antenna(s) (with matching network(s) 23, and/or frequency tuning network(s)) and electrical connection mechanism(s) (e.g., spring(s) 25), and this shielding cover or shielding layer 112*b* and the connector 112*d* (which is a conductive part) on the connecting base 112*c* are electrically conductive to a conductive ground or a conductive structure (preferably a metal ground or a metal structure) in a module carrier 112.

The examples described above only express several embodiments of the present invention, and the description thereof is relatively specific and detailed, but it cannot thus be understood as a limitation to the scope of the present invention. It should be pointed out that for those ordinarily skilled in the art, without departing from the concept of the present invention, several variants and improvements can be further made, which all fall within the protection scope of the present invention. Therefore, the protection scope of the present invention shall be subject to the appended claims.

The invention claimed is:

1. A diverse integration module system of millimeter-wave and non-millimeter-wave antennas characterized by comprising a millimeter-wave antenna module and a non-millimeter-wave environment, wherein the millimeter-wave antenna module further comprises a module carrier, one or more millimeter-wave antennas and a conductive region arranged on the module carrier, the non-millimeter-wave environment comprises one or more feeding sources, the conductive region forms a communication connection with the one or more feeding sources to achieve a function of one or more virtual non-millimeter-wave antennas, the system is further provided with a thermally conductive or electrically conductive material for conducting heat from a high-heat region of the system out of the system, the thermally conductive or electrically conductive material is connected to the conductive region and a conductive ground, the module carrier comprises a first side, a second side, a third side respectively connected with two opposite ends of the first side, a fourth side connected with the second side and the third side, and a top side connected with the first side, the second side, the third side and the fourth side, the one or more millimeter-wave antennas are arranged on the first side, the conductive region are arranged on the fourth side, the system further comprises a first physical non-millimeter wave antenna and a second physical non-millimeter wave antenna, the first physical non-millimeter-wave antenna is arranged on the second side and the top side and extends from the second side to the top side; the second physical non-millimeter-wave antenna arranged on the third side and the top side and extends from the third side to the top side, the thermally conductive or electrically conductive material is arranged on the fourth side.

2. The diverse integration module system of millimeter-wave and non-millimeter-wave antennas according to claim 1, wherein the millimeter-wave antenna module further comprises a millimeter-wave radio frequency chip, and the millimeter-wave radio frequency chip is electrically connected to the one or more millimeter-wave antennas.

3. The diverse integration module system of millimeter-wave and non-millimeter-wave antennas according to claim 2, wherein the system further comprises one or more physical non-millimeter wave antennas arranged on the millimeter-wave antenna module, the millimeter-wave radio frequency chip and the one or more physical non-millimeter-wave antennas are set in the same surface at the module carrier or in non-parallel surface at the module carrier.

4. The diverse integration module system of millimeter-wave and non-millimeter-wave antennas according to claim 2, wherein the non-millimeter-wave environment further comprises one or more feeding lines, and each of the one or more feeding sources forms a communication connection with the millimeter-wave antenna module via one of the one or more feeding lines to achieve the function of the one or more virtual non-millimeter-wave antennas.

5. The diverse integration module system of millimeter-wave and non-millimeter-wave antennas according to claim 4, wherein the communication connection is an electrical connection, or a coupling connection, or an inductive connection.

6. The diverse integration module system of millimeter-wave and non-millimeter-wave antennas according to claim 5, wherein the conductive region makes an electrical connection, or a coupling connection, or an inductive connection with the one or more feeding lines; and is electrically conductive to the conductive ground or a conductive mechanism in the millimeter-wave antenna module.

7. The diverse integration module system of millimeter-wave and non-millimeter-wave antennas according to claim 6, wherein each of the one or more feeding lines is further provided with a matching network and/or a frequency tuning network for non-millimeter-wave antennas.

8. The diverse integration module system of millimeter-wave and non-millimeter-wave antennas according to claim 6, wherein the conductive region is selected from a conductive wall, a shielding cover or a shielding layer of the millimeter-wave antenna module, a connector, a connecting base arranged on a side surface of the module carrier.

9. The diverse integration module system of millimeter-wave and non-millimeter-wave antennas according to claim 2, wherein the system further comprises other chips which, together with the millimeter-wave radio frequency chip, are the high-heat region, and the other chips are selected from any one or more of a power management chip, an operation processing chip, and a data storage chip.

10. The diverse integration module system of millimeter-wave and non-millimeter-wave antennas according to claim 2, wherein the one or more millimeter-wave are in the form of any one of a single linearly-polarized antenna, a dual linearly-polarized antenna, a single circularly-polarized antenna, or a dual circularly-polarized antenna working in a single band or diverse bands;

or the one or more millimeter-wave antennas constitute more than one millimeter-wave antenna array; and each of the millimeter-wave antenna array is any one of a linear array, a square array, a rectangular array, a triangular array, a circular array, and a non-equidistant array;

or the one or more millimeter-wave antennas constitute a millimeter-wave antenna array, and the millimeter-wave antenna array is a one-dimensional linear array, and a size of each millimeter-wave antenna is less than or equal to two equivalent guided wavelengths at a lowest operating frequency of each millimeter-wave antenna; a spacing between two adjacent millimeter-wave antennas is less than or equal to two free-space wavelengths at the lowest operating frequency.

11. The diverse integration module system of millimeter-wave and non-millimeter-wave antennas according to claim 2, wherein the module carrier comprises a first side, a second side and a third side respectively connected with two opposite ends of the first side, and a top side connected to the first side, the second side and the third side; the system further comprises a physical non-millimeter wave antenna arranged on the millimeter-wave antenna module, the one or more millimeter-wave antennas is arranged on the first side, the physical non-millimeter-wave antenna arranged on the second side and the top side and extends from the second side to the top side.

12. An electronic apparatus, characterized by comprising the diverse integration module system of antennas of claim 1, the millimeter-wave antenna module being provided thereon with a connecting base, the connecting base being connected to a mainboard of the electronic apparatus, wherein the non-millimeter-wave environment is provided on the mainboard of the electronic apparatus.

13. The diverse integration module system of millimeter-wave and non-millimeter-wave antennas according to claim 1, wherein the one or more feeding sources are communicated with the conductive region through one or more feeding lines, a plane where the one or more feeding lines are arranged is orthogonal to a plane where the one or more millimeter-wave antennas are arranged.

* * * * *